United States Patent [19]

Chap

[11] Patent Number: 4,573,591

[45] Date of Patent: Mar. 4, 1986

[54] MOLDED SHOWER SHELF

[75] Inventor: John P. Chap, Lemont, Ill.

[73] Assignee: Selfix, Inc., Chicago, Ill.

[21] Appl. No.: 691,644

[22] Filed: Jan. 15, 1985

[51] Int. Cl.[4] ..... A47F 5/00

[52] U.S. Cl. ..... 211/113; D6/525

[58] Field of Search ..... 211/113, 126, 119, 88; D6/525

[56] References Cited

U.S. PATENT DOCUMENTS

| | | | |
|---|---|---|---|
| D. 195,452 | 6/1963 | Bernay | D6/525 |
| 1,039,359 | 9/1912 | Brown . | |
| 2,518,549 | 3/1947 | Hyde . | |
| 2,620,074 | 10/1949 | Moore, Jr. . | |
| 2,743,020 | 8/1952 | Rubenstein . | |
| 3,088,597 | 5/1963 | Ritchey . | |
| 3,115,107 | 12/1963 | Glenny . | |
| 3,181,702 | 5/1965 | Raphael | 211/119 |
| 3,295,471 | 1/1967 | Cook . | |
| 3,547,321 | 12/1970 | Crane | 223/88 |
| 3,638,890 | 2/1972 | Burrell et al. | 211/113 X |
| 3,789,996 | 2/1974 | Stroh | 211/119 |
| 3,900,110 | 8/1975 | Soroka | 211/113 |
| 3,923,162 | 12/1975 | Hussey | 211/119 |
| 4,387,811 | 6/1983 | Ragir et al. | 211/119 |
| 4,398,309 | 8/1983 | Simons | D6/525 X |

FOREIGN PATENT DOCUMENTS

| | | |
|---|---|---|
| 841186 | 7/1960 | United Kingdom . |
| 1011932 | 12/1965 | United Kingdom . |

OTHER PUBLICATIONS

Photographic exhibits (two) showing five commercially available molded plastic hook devices having I-beam cross-sectional portions; Selfix, Inc.; 1983.

*Primary Examiner*—Robert W. Gibson, Jr.

*Attorney, Agent, or Firm*—Dressler, Goldsmith, Shore, Sutker & Milnamow, Ltd.

[57] ABSTRACT

A molded, one-piece shower shelf construction is disclosed which has been particularly configured for efficient and economical fabrication by injection molding. In the illustrated embodiment, the construction includes a pair of spaced apart, generally vertically extending leg portions between which extend a plurality of integrally formed shelves which permit convenient placement and storage of articles on the construction. Notably, the construction preferably includes a generally inverted U-shaped gripping portion which receives an associated shower pipe for mounting of the construction thereon, with the gripping portion preferably provided with an I-beam cross-sectional configuration for resilient, secure gripping coaction with the shower pipe.

9 Claims, 7 Drawing Figures

FIG. 1
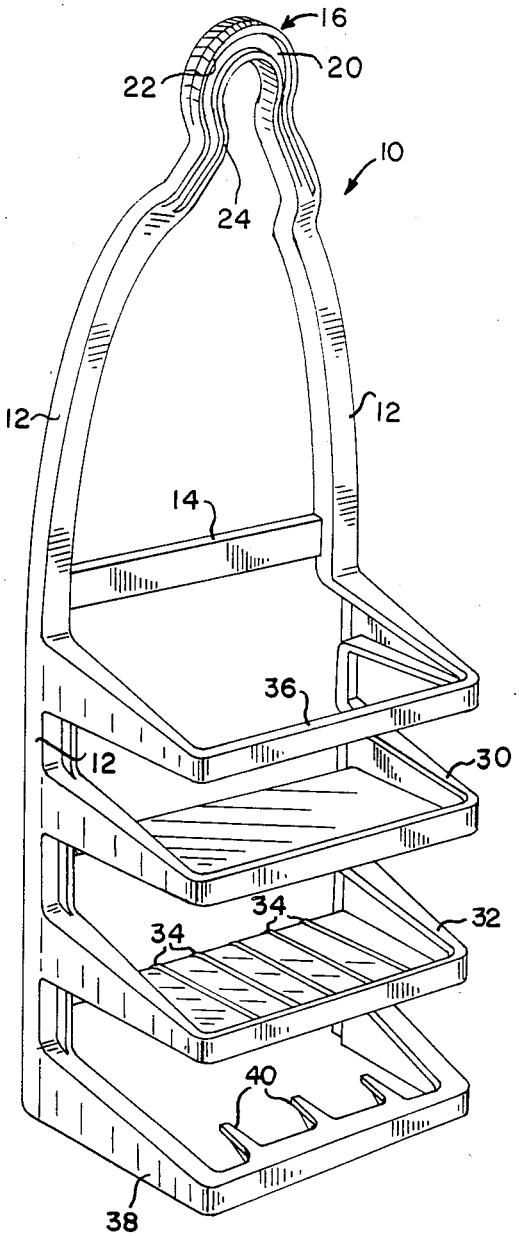
FIG. 3
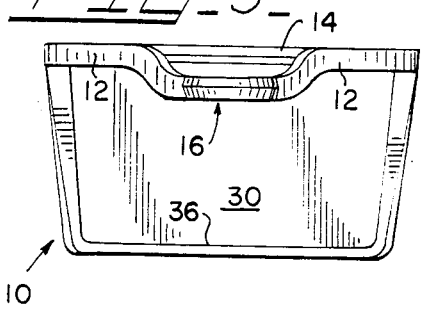
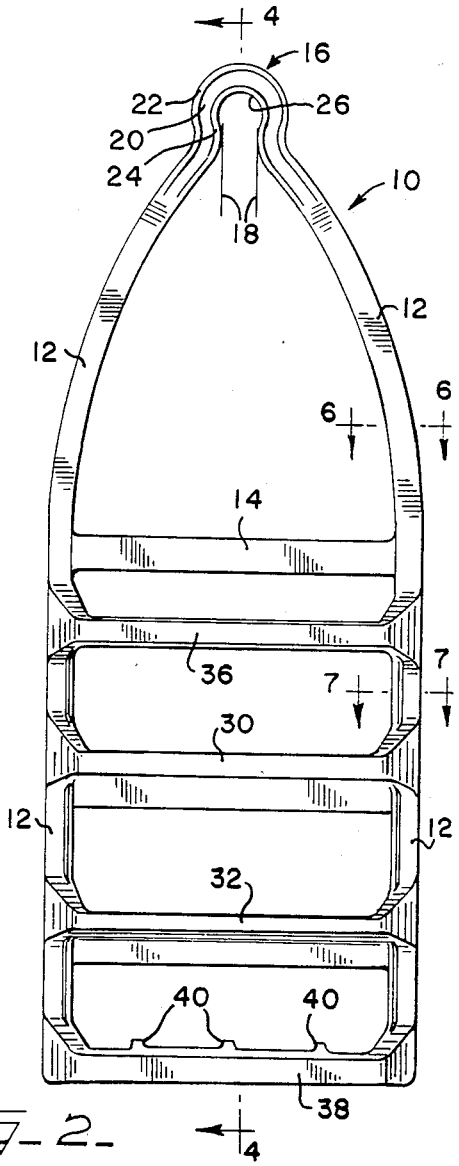
FIG. 2

MOLDED SHOWER SHELF

TECHNICAL FIELD

The present invention relates generally to shelf constructions and the like configured for mounting on a shower head pipe in a bathtub or shower stall, and more particularly to a one-piece molded plastic shower shelf construction configured for secure and stable mounting on an associated shower pipe without the use of additional connectors or attachments.

BACKGROUND OF THE INVENTION

One particularly useful and popular type of shelf construction is an arrangement configured to be mounted in a bathtub or shower stall on a shower head and pipe. These types of shower shelves, sometimes referred to as "shower caddies", ordinarily are configured to support articles such as shampoo and creme rinse bottles, soap, washcloths, and the like for convenient use by bathers.

One shower shelf construction which has proven to be particularly popular with consumers is illustrated in U.S. Pat. No. 4,387,811. The shower shelf construction disclosed in this patent may be formed from plastic-coated metal wire for durability and corrosion-resistance. Significantly, the shelf construction illustrated in this patent includes an upper, generally inverted U-shaped gripping portion which receives the associated shower pipe, with the gripping portion defining a relatively reduced throat area so that the gripping portion coacts with the shower pipe to resist both longitudinal and rotational movement of the shelf with respect to the pipe. The resultant shelf construction is desirably stable and secure in use, and resists tipping or the like even if articles are placed in off-center relation to the shelf's centerline.

Although a plastic-coated wire shower shelf construction can be economically fabricated, techniques for injection-molding plastic material have become sufficiently sophisticated to permit very economical fabrication of articles, even those having relatively complex shapes. The present invention relates to a shower shelf construction which has been particularly configured for efficient injection-molding in one piece, with the preferred embodiment arranged to exhibit significant structural integrity and stability in use, while desirably minimizing the quantity of plastic material required for molding.

SUMMARY OF THE INVENTION

A molded, one-piece shower shelf construction embodying the principles of the present invention is disclosed which has been particularly configured for efficient and economical fabrication from plastic material. Notably, the present construction is configured to coact with an associated shower pipe or the like to resist both longitudinal and rotational movement with respect to the pipe without resort to additional connector components. Desirably secure and stable mounting for the structure is thus achieved, thereby facilitating convenient storage of bathing articles on the shelf.

The present shower shelf construction is adapted to be suspended from an associated shower pipe extending from a wall, and preferably comprises a unitary, one-piece plastic injection-molding. The shelf construction includes a generally vertically oriented frame having a pair of spaced-apart, generally vertical leg portions.

The shelf frame further includes a generally inverted U-shaped gripping portion which is adapted to receive the shower pipe therein, with the upper ends of the vertical leg portions extending toward each other and being respectively integrally joined to legs of the inverted U-shaped gripping portion.

Significantly, the gripping portion of the construction is configured to resiliently grip the shower pipe for arresting movement of the shelf construction relative to the shower pipe. To this end, the gripping portion preferably defines a relatively reduced throat area which coacts with the generally downwardly facing surface of the shower pipe for maintaining the shelf construction in position with respect to the pipe.

The desired resilient gripping action provided by the inverted U-shaped gripping portion of the construction is desirably enhanced by the illustrated I-beam cross-sectional configuration of the gripping portion. This preferred cross-sectional configuration includes a central web and a pair of inner and outer flanges respectively joined to the web such that the inner flange is adapted to engage the shower pipe for resisting movement of the shelf construction toward and away from the associated wall. This I-beam configuration desirably acts to balance forces exerted on the central web of the gripping portion attendant to movement of the shelf construction toward or away from the associated wall, thus desirably minimizing such movement. Notably, this I-beam cross-sectional configuration for the gripping portion provides desired flexible resilience for stability, while resisting formation of stress cracks or the like which could otherwise be a of concern if the gripping portion were formed of a "solid" (such as circular) cross-sectional configuration.

In the preferred form, coaction of the resilient gripping portion with the associated shower pipe is facilitated by providing the inner surface of the inner flange of the gripping portion with a substantially flat surface. Frictional engagement of the gripping portion with the shower pipe is thus desirably enhanced for secure and stable mounting.

In the preferred form, the generally inverted U-shaped gripping portion is offset forwardly of the substantial vertical extent of the vertical leg portions of the shelf frame. This desirably facilitates positioning of the shelf construction substantially adjacent to the associated wall.

Further features of the present shelf construction facilitate convenient use by consumers. In the illustrated embodiment, the frame of the shelf includes a lower, generally U-shaped portion which extends forwardly of and between respective lower ends of the vertical leg portions. This lower frame portion is preferably configured to receive articles to be hung or suspended from the shower shelf, and to this end, preferably includes at least one rearwardly extending projection for receiving such articles.

The present construction includes at least one, and preferably a plurality of shelves which extend between and are integrally joined to the vertical leg portions of the shelf frame. In the illustrated embodiment, a pair of such shelves are provided, with a generally U-shaped retaining member preferably provided in spaced relation above the uppermost one of the shelves for retaining articles in position on that one shelf. Thus, relatively tall articles such as bottles or the like can be conveniently and securely stored on the shelf.

Other features and advantages of the present invention will become readily apparent from the following detailed description, the accompanying drawings, and the appended claims.

BRIEF DESCRIPTION OF THE DRAWINGS

FIG. 1 is a front perspective view of a molded shower shelf construction embodying the principles of the present invention;

FIG. 2 is a front elevational view of the shower shelf shown in FIG. 1;

FIG. 3 is a top plan view of the shower shelf shown in FIG. 1;

DETAILED DESCRIPTION

Figure 4:
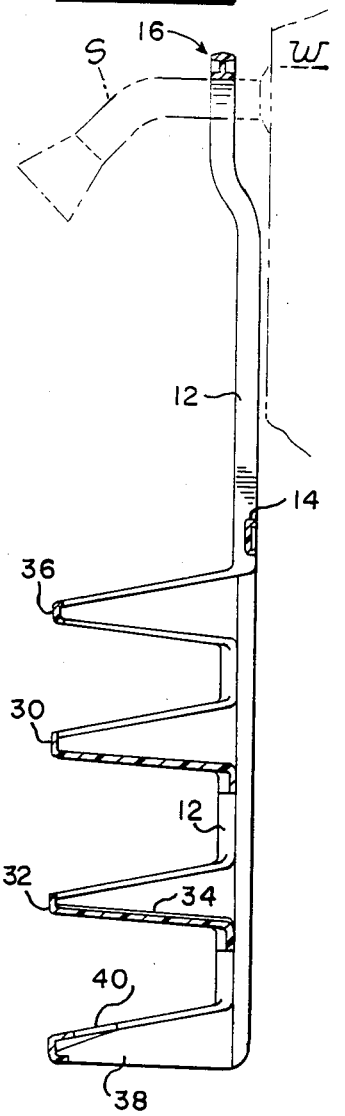
FIG. 4 is a cross-sectional view of the present shelf taken along line 4—4 of FIG. 2.

While the present invention is susceptible of embodiment in various forms, there is shown in the drawings and will herinafter be described a presently preferred embodiment, with the understanding that the present disclosure is to be considered as an exemplification of the invention, and is not intended to limit the invention to the specific embodiment illustrated.

With reference now to the drawings, therein is illustrated a molded, one-piece shower shelf construction 10 embodying the principles of the present invention. Shower shelf 10 is adapted to be suspended from an associated shower pipe S which typically extends from a wall W, as shown in FIG. 4. As will become apparent, shower shelf 10 has been particulary configured for highly efficient and economical injection-molding from suitable plastic material, such as polyethylene, polypropylene, or styrene. Not only is molding of the present construction from plastic material desirably economical, thus promoting affordable use of the shelf construction by consumers, but further provides the construction with an attractive, corrosion-resistant finish.

Figure 6:
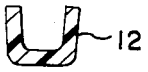
FIG. 6 is a cross-sectional view taken generally along lines 6—6 of FIG. 2.
Figure 7:
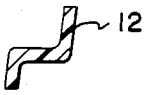
FIG. 7 is a cross-sectional view taken generally along lines 7—7 of FIG. 2.

As illustrated, the present shelf construction 10 includes a substantially vertically oriented frame including a pair of spaced apart, generally vertically extending leg portions 12. In the preferred form, the frame includes a cross-brace 14 which extends between the leg portions 12, with the cross-brace 14 preferably provided with a generally U-shaped cross-sectional configuration, as shown in FIG. 4. The upper ends of vertical leg portions 12 are also preferably provided with a generally U-shaped cross-sectional configuration (see FIG. 6), with the cross-sectional configuration of the leg portions 12 being generally Z-shaped below cross-brace 14 (see FIG. 7).

Significantly, the present shower shelf construction includes a generally inverted U-shaped gripping portion, designated 16, which as been specifically configured to coact with shower pipe S for resisting rotational, longitudinal, and angular movement of the shelf construction with respect to the shower pipe. Such desirably secure and stable mounting is in part provided by configuring the gripping portion 16 to define a throat area of a relatively reduced dimension, as indicated at 18 in FIG. 2. Formation of gripping portion 16 with this configuration facilitates coaction of the gripping portion with the shower pipe for arresting movement of the shelf construction 10 with respect to the pipe.

Figure 5:
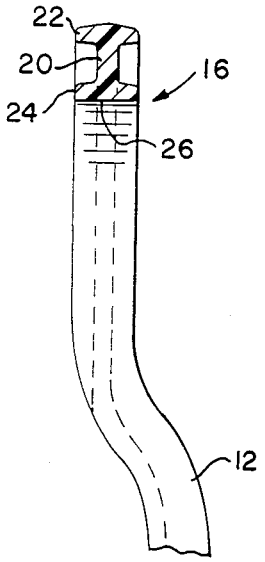
FIG. 5 is a fragmentary, relatively enlarged cross-sectional view of a gripping portion of the present shower shelf construction.

As best shown in FIG. 5, gripping portion 16 is preferably provided with an I-beam cross-sectional configuration, and thus includes a central web 20, and inner and outer flanges 22 and 24 respectively integrally joined to opposite edges of the central web. It will be noted that this preferred I-beam configuration desirably acts to balance the forces exerted on central web 20 by the inner flange 24 attendant to movement of the shelf construction toward or away from the wall W from which the shower pipe extends. In this manner, such movement toward or away from the associated wall is resisted, desirably lending stability to the entire shelf construction. It will also be observed in FIG. 5 that the inner surface 26 of inner flange 24 is substantially flat, and is disposed in right-angle relation to a plane defined by the substantial vertical extent of vertical leg portions 12. This substantially flat surface 26 of inner flange 24 desirably enhances frictional engagement of the gripping portion 16 with the associated shower pipe S, thus desirably enhancing the stability of the shelf structure when it is suspended from the shower pipe.

Formation of gripping portion 16 with the illustrated I-beam cross-sectional configuration is a particularly desirable feature of the present construction. As noted, this configuration acts to balance forces exerted on central web 20 by inner flange 24 for desired stability. Further, the cross-sectional configuration provides sufficient resilient flexibility for the gripping portion to permit flexing and fitment to shower pipe S while minimizing formation of stress cracks or the like which could otherwise occur if gripping portion 16 were formed with a "solid" cross-section (i.e., circular or the like). Formation of the I-beam cross-section also desirably acts to minimize the quantity of plastic material employed in the construction for economy, permits relative fast injection-molding "cycling", and avoids undesired formation of air bubbles.

As noted, the upper end portions of vertical leg portions 12 are joined to respective legs of the inverted U-shaped gripping portion 16. In this regard, it will be observed that the U-shaped cross-sectional configuration of the upper ends of the leg portions merges into the I-beam configuration of the gripping portion 16. Thus, gripping portion 16 is provided with the preferred I-beam configuration, while other portions of the construction are provided with an easier-to-mold U-shaped or channel cross-section.

Further stability for the shelf construction is desirably provided by formation of gripping portion 16 in forwardly offset relation to the vertical leg portions 12, as best shown in FIG. 4. This preferred construction permits the substantial vertical extent of the shelf structure to be positioned substantially adjacent to wall W, thus abating pendulous movement of the shelf.

To facilitate convenient storage of articles on the shelf construction, the arrangement includes at least one, and preferably a plurality of shelves which extend integrally between the vertical leg portions 12. In the illustrated embodiment, a pair of such shelves are provided, including a first integrally formed upper shelf 30 and a second, integrally formed lower shelf 32. As best shown in FIG. 4, these shelves are configured to facilitate efficient injection-molding, while at the same time contributing to the overall structural integrity of the shelf construction. As illustrated, one of the shelves can be configured to permit storage of a bar of soap, and to this end, lower shelf 32 is preferably provided with integral upstanding ridges 34 to facilitate draining of water from a bar of soap placed thereon.

To facilitate placement of relatively tall articles on the shelf construction, a generally U-shaped retaining member 36 is provided which extends between and forwardly from the vertical leg portions 12. Retaining member 36 is positioned in spaced relation above the uppermost one of the shelves 30 and 32 (i.e., shelf 30), and thus acts to retain bottles or the like placed on the shelf 30, with cross-brace 14 further acting to retain such articles in position on shelf 30.

For versatile use, the present shower shelf construction preferably includes an arrangement for hanging articles from the shelf. To this end, the frame of the construction preferably includes a generally U-shaped hanging portion 38 which extends between and forwardly of respective lower ends of vertical leg portions 12. In the preferred form, one or more hanging projections 40 are provided which extend rearwardly from the forward edge of hanging portion 38. In the illustrated embodiment, three such hanging projections 40 are shown, with this arrangement not only facilitating hanging of washcloths and the like, but further permitting razors or like articles to be conveniently hung from the shelf structure.

Thus, a molded shower shelf construction is disclosed which can be readily and efficiently formed from injection-molded plastic material, and which has been configured to promote convenient and versatile use by consumers.

From the foregoing, it will be observed that numerous modifications and variations can be effected without departing from the true spirit and scope of the novel concept of the present invention. It is to be understood that no limitation with respect to the specific embodiment disclosed is intended or should be inferred. It is, of course, intended to cover by the appended claims all such modifications as fall within the scope of the claims.

What is claimed is:

1. A one-piece shower shelf construction adapted to be suspended from an associated shower pipe extending from a wall, comprising:

a frame including a pair of spaced-apart generally vertical leg portions, and generally inverted U-shaped gripping means adapted to receive said shower pipe therein, the upper ends of said leg portions extending toward each other and being integrally joined to said inverted U-shaped gripping means, said gripping means being configured to resiliently grip said shower pipe for arresting movement of said shelf construction relative to said shower pipe, said gripping means having an I-beam cross-sectional configuration including a central web and a pair of inner and outer flanges respectively joined to said web whereby said inner flange is adapted to engage said shower pipe for resisting movement of said shelf construction toward and away from said wall, said upper ends of said pair of vertical leg portions having a generally U-shaped cross-sectional configuration merged into said I-beam cross-sectional configuration of said inverted U-shaped gripping means, said gripping means being offset forwardly with respect to the substantial vertical extent of said vertical leg portions to facilitate positioning of said shelf construction substantially adjacent to said wall; and at least one shelf extending integrally between said leg portions of said frame for receiving and supporting articles thereon.

2. A shower shelf construction in accordance with claim 1, wherein said inner flange of said gripping means defines a substantially flat inner surface adapted to engage said shower pipe for enhancing engagement of said gripping means with said shower pipe.

3. A shower shelf construction in accordance with claim 1, wherein said frame includes a lower, generally U-shaped portion extending forwardly of and between respective lower ends of said vertical leg portions for receiving articles to be hung from said shower shelf.

4. A shower shelf construction in accordance with claim 3, wherein said generally U-shaped frame portion includes at least one rearwardly extending projection for receiving articles to be hung from said shower shelf.

5. A one-piece molded plastic shower shelf construction adapted to be suspended from an associated shower pipe extending from a wall, comprising:

a frame including a pair of spaced-apart generally vertical leg portions, and generally inverted U-shaped gripping means adapted to receive said shower pipe therein, the upper ends of said leg portions extending toward each other and being integrally joined to said inverted U-shaped gripping means, said gripping means being configured to resiliently grip said shower pipe for arresting movement of said shelf construction relative to said shower pipe, said gripping means having an I-beam cross-sectional configuration including a central web and a pair of inner and outer flanges respectively joined to said web whereby said inner flange is adapted to engage said shower pipe for resisting movement of said shelf construction toward and away from said wall, said upper ends of said pair of vertical leg portions having a generally U-shaped cross-section configuration merged into said I-beam cross-sectional configuration of said inverted U-shaped gripping means, said gripping means being offset forwardly with respect to the substantial vertical extent of said vertical leg portions to facilitate positioning of said shelf construction substantially adjacent to said wall; and a plurality of shelves extending integrally between said leg portions of said frame for receiving and supporting articles thereon, said frame including a lower generally U-shaped portion extending forwardly of and between respective lower ends of said vertical leg portions for receiving articles to be hung from said shower shelf, said U-shaped frame portion including at least one rearwardly extending projection for receiving articles to be hung from said shower shelf.

6. A shower shelf construction in accordance with claim 5, wherein said inner flange of said gripping means defines a substantially flat inner surface adapted to engage said shower pipe for enhancing engagement of said gripping means with said shower pipe.

7. A shower shelf construction in accordance with claim 5, including a generally U-shaped retaining member extending integrally between and forwardly of said vertical leg portions in spaced relation above an uppermost one of said shelves for retaining articles in position on said one of said shelves.

8. A one-piece molded plastic shower shelf construction adapted to be suspended from an associated shower pipe extending from a wall, comprising:

a frame including a pair of spaced-apart generally vertical leg portions, and generally inverted U-shaped gripping means adapted to receive said shower pipe therein, the upper ends of said leg portions extending toward each other and being integrally joined to said inverted U-shaped gripping means, said frame including a lower generally U-shaped portion extending forwardly of and between respective lower ends of said vertical leg portions, said U-shaped frame portion including at least one rearwardly extending projection for receiving articles to be hung from said shower shelf, said gripping means being configured to resiliently grip said shower pipe for arresting movement of said shelf construction relative to said shower pipe, said gripping means having an I-beam cross-sectional configuration including a central web and a pair of inner and outer flanges respectively joined to said web whereby said inner flange is adapted to engage said shower pipe for resisting movement of said shelf construction toward and away from said wall, said upper ends of said pair of vertical leg portions having a generally U-shaped cross-sectional configuration merged into said I-beam cross-sectional configuration of said gripping means, said gripping means being offset forwardly with respect to the substantial vertical extent of said vertical leg portions to facilitate positioning of said shelf construction substantially adjacent to said wall;

a plurality of shelves extending integrally between said leg portions of said frame for receiving and supporting articles thereon, and a generally U-shaped retaining member extending integrally between and forwardly of said uppermost one of said shelves for retaining articles in position on said one of said shelves, said frame including a cross-brace extending integrally between said upper ends of said leg portions for cooperation with said U-shaped retaining member for retaining articles in position on said uppermost one of said shelves.

9. A shower shelf construction in accordance with claim 8, wherein said leg portions of said frame comprising portions having a generally Z-shaped cross-sectional configuration below said cross-brace.

* * * * *